US006161792A

United States Patent [19]

Kayser

[11] Patent Number: 6,161,792

[45] Date of Patent: Dec. 19, 2000

[54] WINDING DEVICE INCLUDING A SUPPORT DEVICE AND WINDING PROCESS

[75] Inventor: Franz Kayser, Geldern, Germany

[73] Assignee: Voith Sulzer Finishing GmbH, Krefeld, Germany

[21] Appl. No.: 09/188,207

[22] Filed: Nov. 9, 1998

[30] Foreign Application Priority Data

Nov. 14, 1997 [DE] Germany ..... 197 50 539

[51] Int. Cl.[7] ..... B65H 18/14

[52] U.S. Cl. ..... 242/541.5; 242/542; 242/542.2; 242/595.1

[58] Field of Search ..... 242/541.4, 541.5, 242/541.6, 541.7, 542, 542.2, 595.1

[56] References Cited

U.S. PATENT DOCUMENTS

| | | | |
|---|---|---|---|
| 2,134,656 | 10/1938 | Breth . | |
| 2,285,358 | 6/1942 | Rode et al. | 242/595.1 X |
| 2,529,184 | 11/1950 | Pearson | 242/542 X |
| 3,145,862 | 8/1964 | Cooper | 242/542 X |
| 3,537,662 | 11/1970 | Keesling et al. | 242/595.1 X |
| 3,556,425 | 1/1971 | Keesling et al. | 242/595.1 X |
| 3,851,832 | 12/1974 | Krueckels et al. | 242/542 X |
| 3,889,831 | 6/1975 | Davis . | |
| 3,917,183 | 11/1975 | Malone | 242/542 X |
| 4,120,463 | 10/1978 | Alinder et al. | 242/595.1 X |
| 4,160,528 | 7/1979 | Malone, Sr. et al. | 242/595.1 X |
| 4,541,585 | 9/1985 | Frye et al. | 242/541.4 X |
| 4,809,921 | 3/1989 | Dueck et al. | 242/595.1 X |
| 4,877,196 | 10/1989 | Heymanns | 242/541.5 |
| 5,562,261 | 10/1996 | Beisswanger et al. | 242/541.7 X |
| 5,647,555 | 7/1997 | Conrad et al. . | |

FOREIGN PATENT DOCUMENTS

| | | |
|---|---|---|
| 0289776 | 5/1991 | European Pat. Off. . |
| 0292451 | 3/1993 | European Pat. Off. . |
| 2384696 | 10/1978 | France . |
| 659080 | 4/1938 | Germany . |
| 2060757 | 6/1972 | Germany . |
| 7925945 | 12/1979 | Germany . |
| 4214713 | 11/1992 | Germany . |
| 4427877 | 3/1996 | Germany . |
| 29611251 | 10/1996 | Germany . |

*Primary Examiner*—Donald P. Walsh
*Assistant Examiner*—William A. Rivera
*Attorney, Agent, or Firm*—Greenblum & Bernstein, P.L.C.

[57] ABSTRACT

Apparatus and process for at least one of winding a material web onto and unwinding a material web off of a winding roll. The apparatus includes a winding roll and a support device, adapted to be positioned against a circumferential portion of the winding roll, that includes a plurality of rotational axes arranged substantially parallel to each other and substantially parallel to a winding axis of the winding roll and a plurality of rotatable rollers arranged on the plurality of rotational axes. The plurality of rotational axes are swivelably coupled to one another substantially perpendicularly to the rotational axes. The process includes turning the winding roll, horizontally tensioning a support device formed as one of a belt and chain, upon attaining a predefined roll diameter, supporting a circumference of the winding roll from below with the support device, and vertically moving ends of the support device at a rate of speed less than approximately a rate of change of diameter of the winding roll.

32 Claims, 4 Drawing Sheets

WINDING DEVICE INCLUDING A SUPPORT DEVICE AND WINDING PROCESS

CROSS-REFERENCE TO RELATED APPLICATIONS

The present application claims priority under 35 U.S.C. § 119 of German Patent Application No. 197 50 539.2, filed on Nov. 14, 1997, the disclosure of which is expressly incorporated by reference herein in its entirety.

BACKGROUND OF THE INVENTION

1. Field of the Invention

The present invention is related to a winding device, particularly for a roll slitter, for winding a material web onto and unwinding a material web off of a winding roll, the winding device including a support device that can be placed against a circumference of the winding roll.

2. Discussion of Background Information

In one of the final manufacturing steps, a paper web is wound into winding rolls, if necessary, after running through a slitting assembly. Very often, a winding core or a winding tube made of cardboard is utilized as the starting point for the winding roll. In particular, when winding fairly wide winding rolls, the winding tube does not possess adequate stiffness. Accordingly, if held at the roll core, i.e., at the center of the winding roll, the winding roll begins to sag or bend in the middle as the diameter, and, therefore, the weight of the roll increases. With such a winding technique, it is generally necessary to also support the winding roll on the circumference. This may be effective in reducing or avoiding sagging, as was recognized in EP 0 289 776 B1. Although this document dealt primarily with unwinding, the problem of supporting a roll of great weight presents itself in a similar manner.

As noted above, as the diameter of the winding roll increases, its weight also increases. Consequently, the force with which the winding roll rests on the support device and, therefore, the contact pressure, also increases with increasing diameter. However, contact pressure is one of the factors that determines the winding tightness (hardness), i.e., the greater the contact force, the greater the winding tightness. However, this occurrence is not desirable because it is more desirable to achieve an opposite winding tightness development over the diameter of the roll, i.e., the roll should be wound tighter in the region of the roll core than on the periphery.

In order to solve this problem, several different approaches are known to those in the art. For example, DE 42 14 713 A1 shows use of a band that is guided over three triangularly arranged supporting rollers, the base of which is arranged to point upward against the direction of gravity. Between the two upper supporting rolls, a free length of the band is arranged and upon which rests the winding roll. When tension of the band is appropriately adjusted, a section of the band contacts the circumference of the winding roll. Accordingly, the force is distributed over a somewhat larger area so that the contact pressure is reduced.

In a solution of this nature, it is relatively difficult to achieve results that are reproducible over the long run because the band changes over time from the stress of the use. While it is possible to compensate for these changes, it is also costly.

Another solution has been disclosed in EP 0 292 451 B1. In this document, one side of the winding roll is arranged to rest against a rider roll. Arranged next to the rider roll, i.e., on the other side, is an additional pair of rolls that is likewise encircled by a band. As the diameter of the winding roll increases, a center point of the winding roll increasingly travels over the roll pair in the direction of the band. In this manner, a better distribution of force should be possible. However, in the end there is a risk that the winding roll will rest a majority of its weight on one or the other of the two rolls of the roll pair and, thus, the winding tightness will becomes too great.

SUMMARY OF THE INVENTION

The present invention provides a device in which the effects of the force on the quality of the winding roll is reduced.

The present invention provides a winding device similar in general to the type discussed above that includes a support device having a plurality, e.g., a great number, of rotatable roll bodies with rotational axes that run substantially parallel to the winding axis and which are swivel-jointed to one another substantially perpendicularly to the rotational axes.

Thus, a "roll carpet" may be utilized as the support device. This roll carpet provides a great plurality of support points for the winding roll. Since the roll bodies are swivel-jointed to one another along the circumferential direction, it is possible to continually adjust the points of support to the winding roll diameter as it changes during winding. Consequently, the weight of the winding roll is distributed over the many support points, i.e., over the many rollers, so that a correspondingly reduced surface pressure occurs in each individual nip that is formed between the winding roll and roll body. In this manner, it is possible to reduce the influence of the force and avoid uncontrolled changes in winding tightness. Because the individual rollers can be arranged to be relatively close to one another in the circumferential direction, only short free path lengths arise, which does not cause further problems. Moreover, a substantially clearly defined supporting force can relatively well provided.

Preferably, the support device may include a tensioning device located on at least one end in the circumferential direction that mainly acts against the direction of gravity. The tensioning device substantially ensures that the support device is held against the circumference of the winding roll with the necessary tension to take up the force. The tensioning device may be utilized to cause a desired part of the circumference of the winding roll to be appropriately acted upon by the support device.

Preferably, the tensioning device may include a lifting device mounted in articulated fashion to a base to cause the support device acting upon the desired part of the circumference. The lifting device has the primary advantage that it can work against the direction of gravity so as to effectively lift the winding roll. The articulated support of the lifting device, which can be implemented, e.g., as a hydraulic lift cylinder, makes it possible for the support device to adjust itself to the changing diameter of the winding roll. The end at which the tensioning device is located may be moved, not only in the vertical direction, but also in the horizontal direction.

Preferably, both ends are provided with a tensioning device. In this manner, it possible to adjust the tensioning device to the circumference of the winding roll.

The necessary tension of the "roll carpet" can also be produced through a tensioning device that also acts in the horizontal direction. The corresponding tension elements, e.g. hydraulic cylinders, can be hung in an articulated fashion to substantially avoid bending moments resulting from the growing roll diameter. The center (and adjacent regions) of the roller carpet can change their vertical position with the diameter of the roll more than the ends. With greater diameter, the roll automatically extends further into the support device so that the number of bearing surfaces adjusts practically automatically to the roll diameter of the winding roll. Further, the use of horizontal and vertical tensioning devices together may be combined.

The tensioning device can either spread apart two stands to which the ends of the support device are attached, or extend the two ends of the support device away from one another.

In one embodiment, the roll bodies may be, e.g., continuous rolls. This embodiment is technically very easy to implement, in that the rolls extend practically over an entire axial length of the support device.

Preferably, the roll bodies can have the form of, e.g., wheels, and may be arranged such that several wheels can have one common rotational axis and an interval remains in the axial direction between individual wheels. In this embodiment, the continuous rollers may be divided into several axial sections. While the rotational axis can be provided as a continuous physical part, this is not necessary. It is sufficient if the center points of several wheels are arranged on an imaginary straight line around which the wheels turn. The term "wheels" is used here to distinguish from continuous "rolls". The wheels can also have a greater axial span than the diameter, but this is not necessary. Preferably the wheels may have a diameter between approximately 100 and 300 mm and an axial span in the range between approximately 25 and 100 mm.

The above-noted embodiment with wheels has a particular advantage in that a connection between rotational axes can be established in at least one interval. This provides for greater stiffness of the support device in the axial direction, and reduces the risk of the support device sagging in the axial direction.

In a particularly preferred embodiment, the wheels of neighboring rotational axes may be arranged to be offset from one another in the axial direction so that the the wheels of one rotational axis jut or extend into the spaces between the wheels on the neighboring rotational axis. With this embodiment, an even denser succession of support or application points for the winding roll can be achieved in the circumferential direction. Without this measure, the interval is in the region of the diameter of one wheel, while, with this measure, the interval may be reduced to approximately one-half. Accordingly, the diameter of the wheels may be selected to be appropriately large. However, larger diameters have a more favorable effect on the local contact pressure.

Preferably, the wheels may be mounted on carrying strips arranged in an articulated manner behind one another in the circumferential direction. In this case, the rotational axes simultaneously form the articulated connections between the carrying strips. The carrying strips provide a relatively great stiffness in the axial direction.

Preferably, each wheel is supported on both axial sides. This increases loading capacity.

The roll bodies may be coupled to one another by an elastic carrier in the circumferential direction of the winding roll. Then, if the ends of the support device do not follow the changes in winding roll diameter or do not follow it adequately, is greater tension at larger roll diameter and thus greater carrying power results.

Advantageously, at least one roll body may have a ventilator arrangement. In operation, the rollers turn at a circumferential speed that is at least approximately the same as the circumferential speed of the winding roll. If rollers with a ventilator arrangement, e.g., baffle plates that act in the manner of a fan, are provided, then the air stream thereby produced may be used for cooling. Heat, which is unavoidably produced in the flexing work during winding, can be dissipated in this manner at little additional cost.

It is also advantageous if at least one roll body is driven. Several advantages may be achieved in this way. By driving at least one roll body, the drive for the winding roll can be relieved. For example, driving power sufficient to the turn the rollers may be built in. Further, the appropriate rollers may be driven with a different circumferential speed than the winding roll so as to influence the winding tightness.

Advantageously, the support device may have an elastic surface. The contact areas between the winding roll and the roll bodies may be broadened or widened in this manner, which also lowers surface pressure. Moreover, the surface of the winding roll may be protected.

The above-noted advantage may be realized by providing rollers with an elastic surface. In this manner, the winding roll may contact many elastic support points, which enlarges the bearing surface, a nearly friction-free movement on the support device is substantially ensured.

For this purpose, the rollers may be filled with foam or air beneath their surface chambers. This may be particularly advantageous when wheels are used as rollers. In this manner, conventional rubber tires, which may be pumped up, may be utilized as wheels. These wheels can be elastic enough to permit soft contact for the winding roll, which results in the desired low surface pressure. In some cases it may be sufficient if the bearing capacity is achieved solely through the stiffness of rubber wheels.

Advantageously, the support device symmetrically engages the winding roll, which results in good controllability of the distribution of forces. Particularly when the roll diameter is increasing, it is not necessary to take any action to compensate for the forces produced by the support device that do not act only in the direction of gravity.

The present invention also relates to a winding process for winding a material web onto or off of a winding roll. The winding roll has a stationary axis that is turned and, at least above a predefined roll diameter, is supported from below at its circumference.

Thus, the present invention includes a band- or chain-like support device that is horizontally tensioned for support, and the ends of the support device may be moved vertically at a speed that is less than the change in diameter of the winding roll.

The support device will be described using a winding-on example. Above a certain diameter, the winding roll has a weight that requires support. Starting from this point in time, i.e., upon attaining the certain diameter, at the latest, it is necessary for the support device to support the circumference of the winding roll. For support, the support device is tensioned. As the diameter of the winding roll increases, the winding roll lowers or sinks even more deeply into the support device. This feature is achieved by lowering the ends of the support device at a rate more slowly than that at which the winding roll grows. In this manner, two effects are achieved: The vertical supporting force is increased because to the horizontal tension rises due to the vertical pressing of the winding roll; and the curvature of the support device automatically approaches the radius of the winding roll. The result is an automatic adaptation of the bearing surface of the support device to the circumferential surface of the winding roll. Thus, the support of the winding roll increases dynamically, so to speak (and decreases dynamically when the winding roll is unwound). In this way, the contact pressure exerted upon the support device by the winding roll always remains within an acceptable amount despite the stationary mounting of the winding roll axis. Naturally, provisions may be made for the ends of the support device to be lowered to avoid excessively great tension on the support device. Since lowering of the ends occurs more slowly than the increase in winding roll diameter, the desired tension continues to be maintained and even increases.

In this connection, it is preferred that the ends of the support device be gripped in a vertical position below the predetermined diameter of the winding roll. As long as the diameter of the winding roll has not yet been achieved, the support device does not have to go into action. However, as soon as this diameter is achieved, the support device is brought to rest against the winding roll.

The predetermined diameter of the winding roll depends primarily upon its width, but it is generally approximately 800 mm or less. However, experience has shown that when the radius is approximately 400 mm, the roll weight is high enough to require support.

Preferably, the ends of the support device may be held to be stationary at a level that is a distance of 45% of the predetermined diameter away from the height at which the winding roll axis is located. In this manner, the fact that the support device sags a bit even when it is horizontally tensioned is taken into consideration. For this reason, the ends of the support device may be positioned a bit higher so that the winding roll comes into contact with the support device practically automatically upon reaching the predetermined diameter. In this context, it is noted that "ends" refers to the ends lying in the circumferential direction of the winding roll. The support device in this context is in the form of a "roller carpet" that was described above.

Accordingly, the present invention is directed to an apparatus for at least one of winding a material web onto and unwinding a material web off of a winding roll. The apparatus includes a winding roll and a support device, adapted to be positioned against a circumferential portion of the winding roll, that includes a plurality of rotational axes arranged substantially parallel to each other and substantially parallel to a winding axis of the winding roll and a plurality of rotatable rollers arranged on the plurality of rotational axes. The plurality of rotational axes are swivelably coupled to one another substantially perpendicularly to the rotational axes.

In accordance with another feature of the present invention, the support device has circumferential ends and may include a tensioning device located on at least one of the circumferential ends that is biased in a direction against the force of gravity. Further, the tensioning device may include a lifting device coupled to a base in articulated fashion. Still further, the tensioning device may be located on both circumferential ends.

In accordance with another feature of the present invention, the support device has circumferential ends and may include a tensioning device coupled to the circumferential ends that is biased in a horizontal direction.

In accordance with still another feature of the present invention, the rollers may be composed of wheels. A plurality of the wheels may be arranged on a common axis with an axial gap provided between adjacent wheels. Further, a connector that couples adjacent rotational axes may be provided. The connector may be located within the axial gap.

In accordance with a further feature of the present invention, the wheels of adjacent rotational axes may be arranged to be offset from one another in the axial direction such that the wheels on one rotational axis extend into the axial gap between the wheels on the adjacent rotational axis. Further, the wheels may be mounted on carrying stips arranged in an articulated manner one behind another in the circumferential direction. Moreover, each wheel may be supported on both axial sides.

In accordance with a still further feature of the present invention, the rollers may be coupled to one another with an elastic carrier in the circumferential direction.

In accordance with still another feature of the present invention, the rollers nay have peripheral surfaces and chambers positioned beneath the peripheral surfaces, and the chambers may be filled with at least one of air and foam.

In accordance with yet another feature of the present invention, the support device may symmetrically engage with the winding roll.

In accordance with another feature of the present invention, a rider roll, adapted to be in contact with the winding roll during winding, having regions with reduced diameter in which the support device, having a limited length in the axial direction, is arranged between the winding roll and the rider roll may be provided.

In accordance with a further feature of the present invention, the apparatus may be adapted for use in a roll slitter.

In accordance with a still further feature of the present invention, the support device may include circumferential ends coupled to rocker arms. The rocker arms positioned at a same axial end of the support device may be coupled together by a cylinder piston device.

In accordance with yet another feature of the present invention, the support device may be coupled to a floor. In accordance with another feature of the present invention, the support device may be coupled to the machine frame.

The present invention may also be directed to a process for at least one of winding one of a material web onto and a material web off of a winding roll having a stationary axis. The process includes turning the winding roll, horizontally tensioning a support device formed as one of a belt and chain, upon attaining a predefined roll diameter, supporting a circumference of the winding roll from below with the support device, and vertically moving ends of the support device at a rate of speed less than approximately a rate of change of diameter of the winding roll.

In accordance with another feature of the present invention, the ends of the support device may be held in a vertical position below the predefined roll diameter of the winding roll. Further, the predefined roll diameter of the winding roll may be less than approximately 800 mm. Further, the ends of the support device may be held stationary at a level that is a distance of approximately 45% of the predefined roll diameter below the winding roll axis.

In accordance with yet another feature of the present invention, the process may further include deforming a peripheral surface of a plurality of support elements of the support device as the diameter of the winding roll increases. The process further may include automatically cooling the deformed support elements of the support device. At least one of the support elements includes a ventilation device.

The present invention may also be directed to a support device for supporting a winding roll in one of a winding-on and a winding-off of the winding roll. The support device includes a plurality of rotatable rollers arranged parallelly to each other and to a winding axis of the winding roll. The plurality of rotatable rollers are swivelably coupled to one another in a circumferential direction.

In accordance with another feature of the present invention, a first and second circumferential end are provided as well as a tensioning device coupled to each of the first and second end. The tensioning device may be adapted to bias the circumferential ends in at least one of a horizontal direction away from each other and a vertical upward direction.

In accordance with yet another feature of the present invention, the plurality of rotatable rollers include a plurality of coaxially arranged wheels having axial gaps provided between adjacent coaxial wheels. The plurality of rotatable rollers are arranged such that at least a portion of a circumferentially adjacent wheel extends into the axial gap between adjacent coaxial wheels.

Other exemplary embodiments and advantages of the present invention may be ascertained by reviewing the present disclosure and the accompanying drawings.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The present invention may be utilized for winding web rolls. While the exemplary description of the present invention discusses a paper web, the present invention should not be construed as limited to this or any other particular web material. Accordingly, the features of the present invention may be practiced with any material web known to those ordinarily skilled in the art. Further, the exemplary descriptions of the features of the present invention are discussed with respect to a winding-on procedure. However, it is noted that it would be apparent to those ordinarily skilled in the art that the present invention is equally applicable to unwinding procedures.

Figure 1:
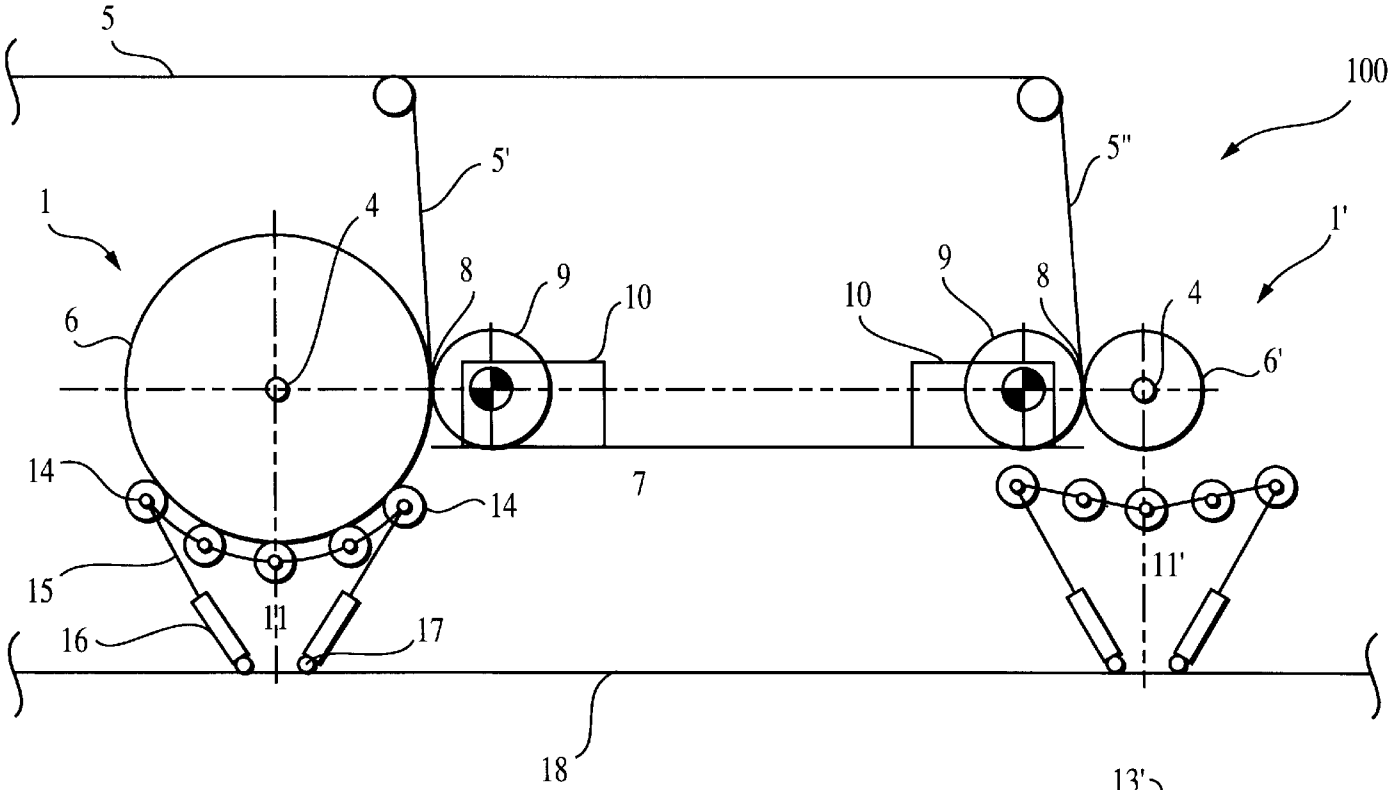
FIG. 1 illustrates a schematic side view of a first embodiment of a winding device of the present invention.

A winding device 100, as schematically illustrated in FIG. 1, has two winding stations 1 and 1' for winding partial webs 5' and 5" from a material web 5 into partial web rolls 6 and 6'. For the sake of clarity and ease of explanation, partial web roll 6 located in the left-hand winding station 1 is depicted in a relatively late stage of the winding process, i.e., having nearly attained its final diameter, and partial web roll 6' located in the right-hand winding station 1', in contrast, is depicted at the start of a winding procedure. Partial web rolls 6 and 6' may be axially held or retained in grip holders and wound onto winding tubes 4. However, in the case of larger roll widths, i.e., the axial length of winding roll 6 or 6', this may lead to a risk of sagging of winding roll 6 or 6' in the axial center. As a result, an uneven and thus undesirable winding may occur.

Accordingly, for a winding-on procedure, partial webs 5' and 5" may be guided through a nip 8 formed between a rider roll 9 and winding roll 6. Rider roll 9 may be capable of travel via a carriage coupled to a base 7, e.g., a machine frame. Although not shown in detail in the exemplary illustration, it is known to utilize rider roll 9 to exert a certain contact pressure on winding roll 6 (or winding tube 4 at the start of the winding procedure) to adjust the winding tightness (hardness).

Figure 2:
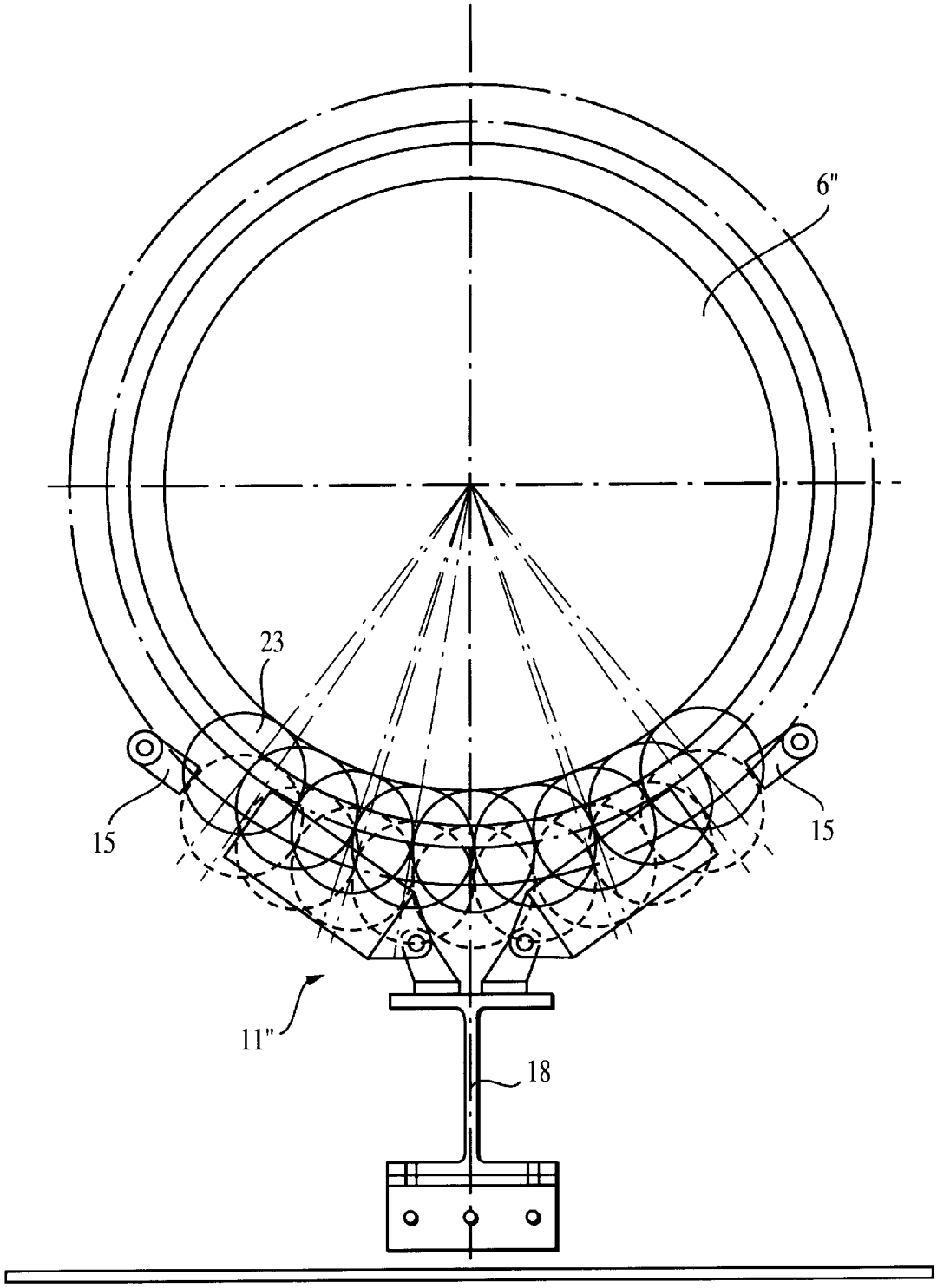
FIG. 2 illustrates a side view of the first embodiment of the support device of the present invention.

To prevent sagging of winding roll 6 and 6', a support device 11 and 11' (associated with winding station 1 and 1', respectively) may be provided. Support devices 11 or 11' are illustrated in greater detail in FIGS. 2 and 3. In FIG. 2, a side view of support device 11" (i.e., from the axial end of winding roll 6") is illustrated; and in FIG. 3, a top view of support device 11 (i.e., only one-half) is illustrated.

At each end of support device 11 (or 11'), i.e., in the circumferential direction, two rams 15 are coupled to one another through a carrier 22. A plurality of more than two supporting elements, e.g., wheels 23, may be provided and arranged on rotational axes, of which rotational axes 24 and 25 are explicitly identified. Wheels 23 may be arranged to provide an axial gap 26 between adjacent wheels 23 on a same rotational axis, and the wheels 23 of adjacent rotational axes may be offset so that wheels 23 on rotational axis 24 extend or jut into the axial gaps of rotational axis 25, and vice versa. As result, and as more clearly shown in FIG. 2, a relatively high packing density is achieved, e.g., the support points for winding roll 6" on support device 11" are arranged relatively close to one another in a peripheral direction. Further, the adjustability of the support device to accommodate various sized winding rolls is shown, e.g., support device 11" is shown supporting a smaller diameter of winding roll 6", which is depicted in solid lines, and supporting a larger diameter of winding roll 6", which is depicted in dashed lines.

Axes of rotation 24 and 25 form swivel points for connecting strips 20 that join the axes of rotations 24 and 25, e.g., in the manner of a chain or belt running in the circumferential direction. Strips 20 may be provided, not only in the region of the axial ends of support device 11, but also on both axial sides of each wheel 23. In this manner, each wheel 23 may be well supported and relatively great stiffness results in the axial direction. Accordingly, rotational axes 24 and 25 practically cannot sag because they are also supported in their axial center.

Axes of rotation 24 and 25 are preferably held to be non-rotatable, while wheels 23 may be pivoted or rotated on rotational axes 24 and 25 with bearings 27.

Figure 3:
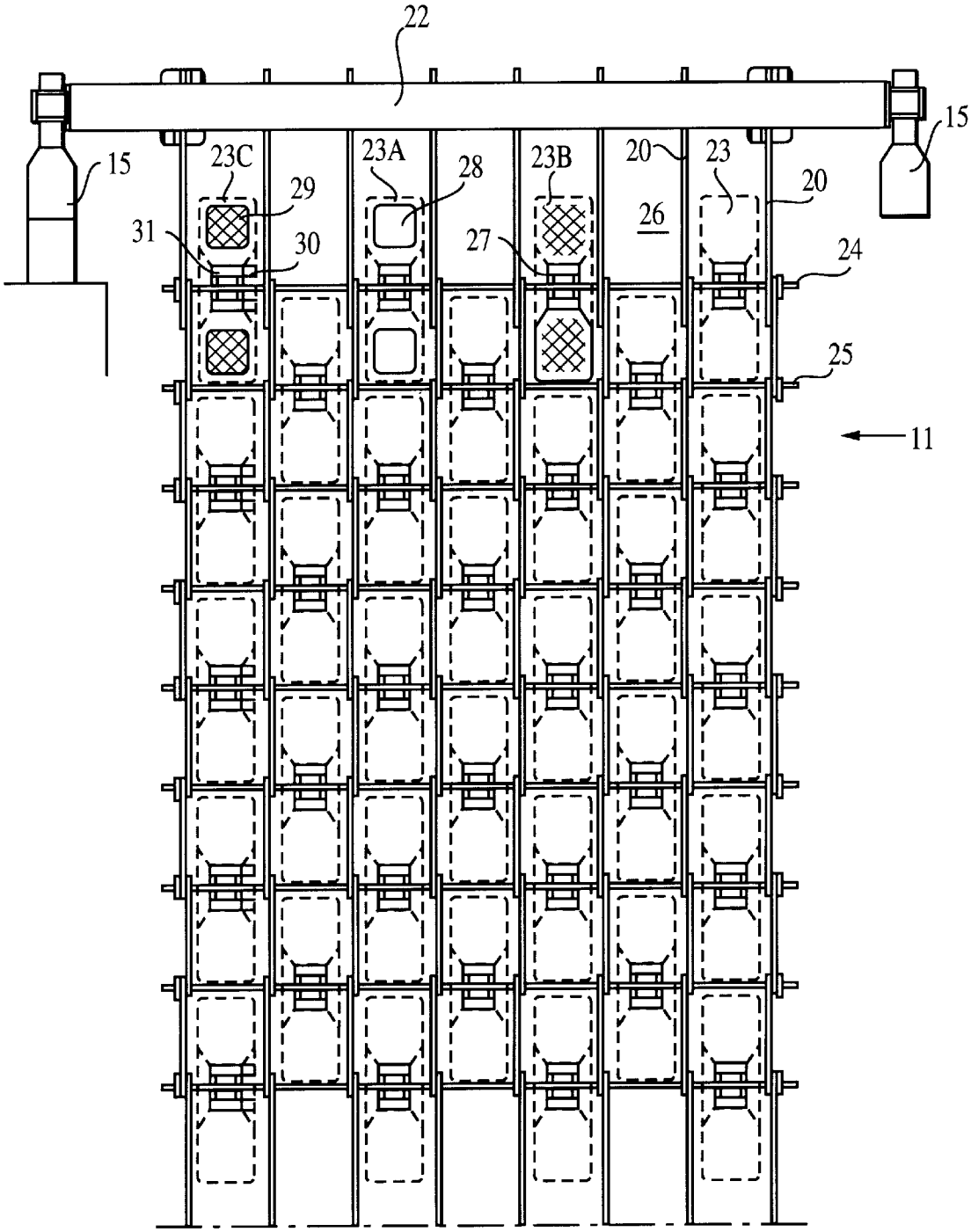
FIG. 3 illustrates a top view of the winding roll with the support device depicted in FIG. 2.

Wheels 23 can be provided in various different forms, three exemplary forms of which are depicted in FIG. 3. Wheel 23A may include an air chamber 28 that can be pumped up and, thus, placed under pressure. This arrangement provides elastic behavior approaching that of an automobile tire, and wheel 23A may be made of, e.g., rubber, plastic, or a plastic-coated thin walled metal. The surface of wheel 23A may have a constant hardness of less than 80 degrees Shore A. Wheel 23B may be made substantially entirely of plastic having a certain elasticity. Wheel 23B may be formed of, e.g., rubber, plastic, or plastic-coated metal. The surface of wheel 23B may have a constant hardness of less than 80 degrees Shore A. In this arrangement, the circumference of wheel 23B may yield somewhat under the load of the weight of winding roll 6, thus, extending the bearing surface. Wheel 23C may include chambers filled with a plastic 29 to provide a predeterminable stiffness. Wheel 23C may be made of, e.g., rubber, plastic, or a plastic-coated thin walled metal, and the chamber may be filled with, e.g., rubber, minerals, or plastic. The plastic filler may be foamed plastic. The surface of wheel 23A may have a constant hardness of less than 80 degrees Shore A.

While various alternative forms are available, it is preferred that as many wheels as possible of support device 11 should have the same structure. In this manner, a more even stress may be applied to the supported portions of winding roll 6.

When wheels 23 are compressible, i.e., even only to a small extent, a certain amount of heat is produced as a result of the sustained flexing work. To dissipate this heat, at least a few wheels may be equipped with ventilation mechanisms 30, e.g., a baffle plate arrangement on hub 31 that acts as a radial fan. Since wheels 23 rotate during operation, his rotational motion may be exploited or utilized to generate a cooling airflow to dissipate the heat. Further, all wheels 23 may be equipped with ventilation mechanisms 30. Ventilation mechanisms 30 may be arranged on both axial ends of wheels 23. In this manner, airflow generated by a ventilation mechanism 30 will be blown directly onto a circumferential surface of wheel 23 of the adjacent axis that extends into axial gap 26.

Figure 4:
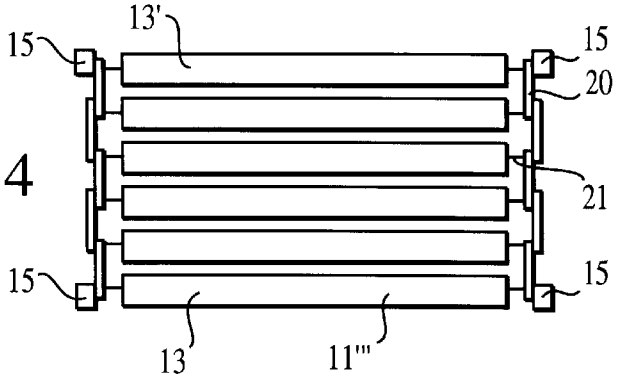
FIG. 4 illustrates a top view of an additional embodiment of a support device.

An alternative embodiment of support device 11 is illustrated in FIG. 4 as support device 11'''. In this alternative embodiment, a plurality of more than two roll bodies formed as, e.g., continuous rollers 13, are arranged to extend over the axial length of support device 11'''. Roller 13' may be a driven roller, and all rollers 13 may include a surface having a certain compressibility (not shown), that forms an elastic surface of support device 11'''.

Individual rollers 13 may be coupled together by strips 20 made of, e.g., strip steel or a thick sheet. In this manner, rotational axes 21 of rollers 13 may simultaneously form swivel points for strips 20. Thus, strips 20 may be swivel-jointed together in the circumferential direction. Rollers 13 may be made of, e.g., rubber-coated or plastic coated light metal so as to have a surface hardness of less than 80 degrees Shore A. It is noted that, a plastic material of various composition may be utilized in place of the light metal as long as the surface hardness parameters are maintained.

Accordingly, both embodiments of support device 11 (and 11''') can lie against a portion of the circumference of winding roll 6, e.g., as illustrated in FIG. 1, for winding station 1. Strips 20 may be formed of, e.g., steel strips. However, strips 20 may be alternatively made of a stable, elastic material, e.g., reinforced plastic having a modulus of elasticity substantially equivalent to that of steel.

Each of the ends 14 of support device 11, i.e., in the peripheral direction, may be coupled to a ram 15 of a lift cylinder 16. Lift cylinders 16 may be swivelably supported via swivel points 17 to a base 18, e.g., the floor. Thus, lift cylinders 16 may be tiltable, as can be seen by comparing the arrangements of lift cylinders 16 of winding stations 1 and 1' of exemplary FIG. 1.

With the aid of lift cylinder 16, the two ends 14 of support device 11 may be raised so that support device 11 substantially clings to the circumference of winding roll 6 like a belt. As the diameter of winding roll 6 increases, the region of winding roll 6 in contact with support device 11 extends downwardly in the direction of gravity. Accordingly, rams 15 of lift cylinder 16 retract to compensate for the expanding winding roll radius.

In accordance with this alternative embodiment of the present invention, a large number of contact points are formed between support device 11 and winding roll 6. Further, it is apparent that, depending upon the desired application, a great number of rollers, i.e., far more than the six rollers 13 and 13' depicted in FIG. 4 can be utilized. Further, the number of contact areas may be smaller at the start of the winding procedure than toward the end of the winding procedure. Accordingly, a higher contact pressure may be achieved with the same amount of force, which, if necessary, can be exerted by a roller from above (not shown in detail), because the force is distributed over fewer nips. As the roll diameter of winding roll 6 increases, the number of nips, i.e., contact points, also rises, so that the contact pressure automatically decreases.

Figure 5:
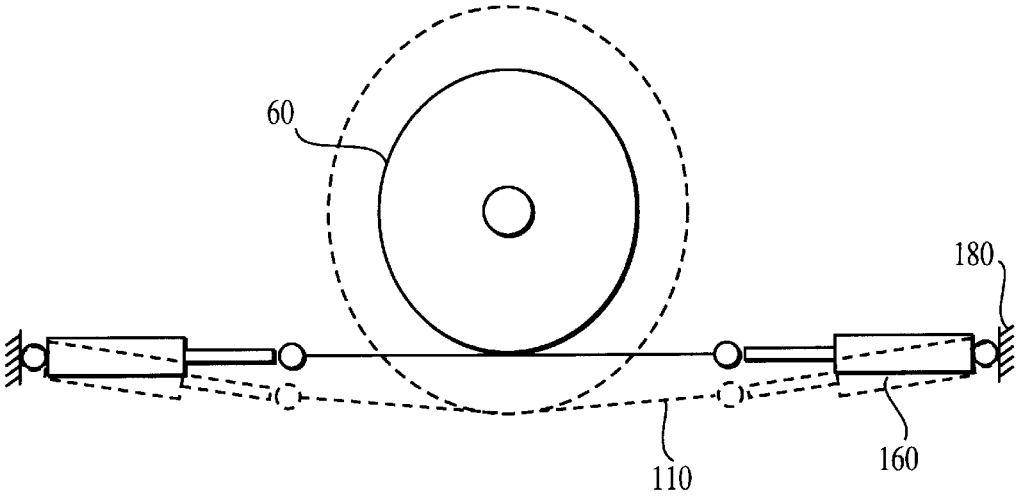
FIG. 5 illustrates a second embodiment of a winding device of the present invention.

FIG. 5 illustrates another alternative embodiment of the present invention in which corresponding parts are identified with the same reference numerals increased by a factor of 10. Thus, in the embodiment of FIG. 5, support device 110 is provided in the form of, e.g., a "roll carpet". For the sake of clarity, the rollers (or wheels), of which there is a plurality of more than two, and, preferably, a great number of rollers (or wheels), have not been depicted in this Figure, only a line which joins the rotational axes of the rollers. Using FIG. 5, a modified form for the suspension of support device 110 is shown. Base 180, no longer formed by the floor, may be formed by two side walls located on both sides of winding roll 60, and may be formed, e.g., by the machine frame. Support 110 may be suspended between base 180 by hydraulic cylinders 160 provided on both ends that may be hung in articulated fashion on base 180. Support device 110 may be tensioned more or less tightly with the aid of cylinder 160.

The winding roll 60 is depicted with two discrete diameters, however, it is apparent that the center point of winding roll 60 is retained at substantially the same height throughout the winding procedure. For the sake of clarity, the holding arm, which is utilized in this arrangement, is not shown. As the diameter of winding roll 60 increases (shown in dashed lines), winding roll 60 extends increasingly into support device 110. When this occurs, the bearing surface also automatically increases. Thus, if the length of support device 11' is kept substantially the same in the horizontal direction, then the tension increases with increasing diameter of winding roll 60, as is the vertically acting restoring force. In this manner, winding roll 6' may be even better supported.

Roll 60 is shown with a solid line at a predetermined or certain diameter that will begin to require support from support device 110. For purposes of explanation, the path of support device 110 is shown in an exaggerated way (i.e., with the solid line) to have a horizontal path. In actual practice, however, support device 110 will include at least a bit sag as a result of its own weight. Accordingly, the ends (i.e., the internal swivel points of cylinder 160) may be arranged so that they are approximately 10% higher (i.e., relative to the radius of winding roll 60) than shown.

As the diameter of winding roll 60 increases, winding roll 60 extends deeper into support device 110 and presses it downwardly. In this manner, the bearing surface automatically increases and the bearing pressure directed vertically upward increases. The increase in pressure may be controlled somewhat in that cylinder 160 may be extended a bit, e.g., to reduce the tension. In this manner, very sensitive control of the bearing force is possible.

The diameter of winding roll 60 at which support device 110 should begin supporting winding roll 60 is approximately 800 mm. Prior to that diameter, it is very often unnecessary to provide support.

Figure 6:
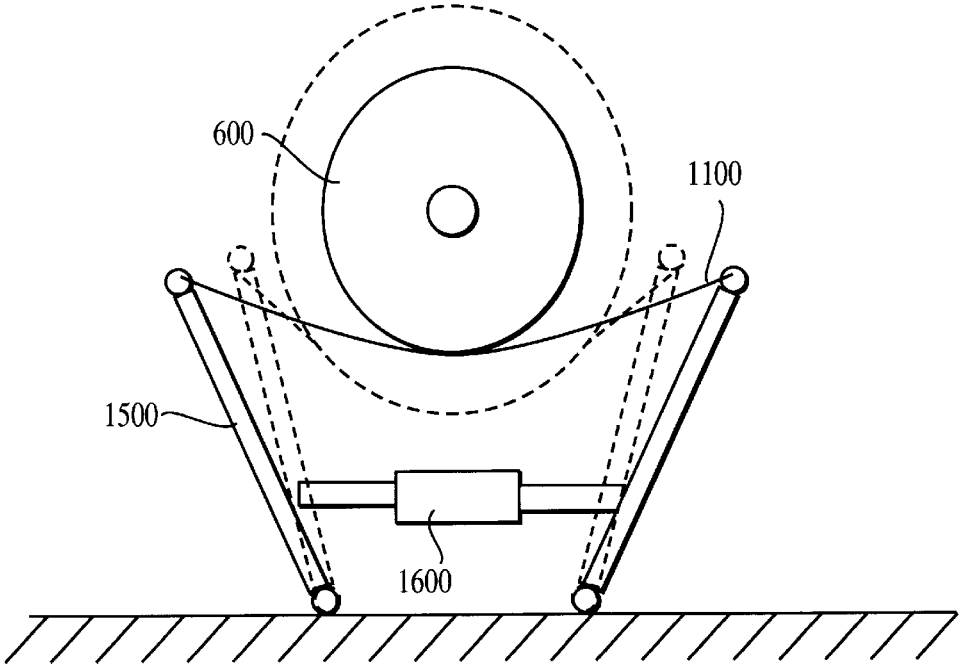
FIG. 6 illustrates a third embodiment of a winding device of the present invention.

In a similar alternative embodiment depicted in FIG. 6, corresponding elements are labeled with reference numerals increased by a factor of 100. Support device 1100 may be hung on two stands 1500 that can be spread apart with the aid of a hydraulic cylinder 1600. The smaller the diameter of winding roll 600, the further apart the two stands 1500 are driven. However, as the diameter of winding roll 600 increases, stands 1500 approach one another more closely.

Particularly in the embodiments depicted in accordance with FIGS. 5 and 6, but also with the other embodiments of the support device of the present invention, the individual rolls can be joined to one another by an elastic band, an elastic carrier, or other structural elements made of elastic, material, e.g., a material with spring action. In this manner, the tension may increase when the winding roll extends more deeply into the support device.

It is noted that the foregoing examples have been provided merely for the purpose of explanation and are in no way to be construed as limiting of the present invention. While the present invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. An apparatus for at least one of winding a material web onto and unwinding a material web off of a winding roll comprising:

a winding roll;

a support device, adapted to be positioned against a circumferential portion of the winding roll, comprising:

a plurality of more than two rotational axes arranged substantially parallel to each other and substantially parallel to a winding axis of the winding roll;

a plurality of more than two rotational rollers arranged along the plurality of more than two rotational axes; and the plurality of more than two rotational rollers being swivelably coupled to one another substantially perpendicularly to the rotational axes and being formed as one of a belt and a chain.

2. The apparatus in accordance with claim 1, the rollers being composed of continuous rolls.

3. The apparatus in accordance with claim 1, the rollers being composed of wheels, wherein a plurality of the wheels are arranged on a common axis with an axial gap provided between adjacent wheels.

4. The apparatus in accordance with claim 3, wherein the wheels of adjacent rotational axes are arranged to be offset from one another in the axial direction such that the wheels on one rotational axis extend into the axial gap between the wheels on the adjacent rotational axis.

5. The apparatus in accordance with claim 3, wherein axles of the wheels are mounted on carrying strips arranged in an articulated manner one behind another in the circumferential direction.

6. The apparatus in accordance with claim 5, each wheel is supported on both axial sides.

7. The apparatus in accordance with claim 1, wherein at least one of the plurality of rollers is driven.

8. The apparatus in accordance with claim 1, wherein the support device has an elastic surface.

9. The apparatus in accordance with claim 1, wherein the rollers have an elastic surface.

10. The apparatus in accordance with claim 1, the rollers having peripheral surfaces and chambers positioned beneath the peripheral surfaces; and the chambers being filled with at least one of air and foam.

11. The apparatus in accordance with claim 1, wherein the support device symmetrically engages with the winding roll.

12. The apparatus in accordance with claim 1, the apparatus being adapted for use in a roll slitter.

13. The apparatus in accordance with claim 1, the support device being coupled to a floor.

14. The apparatus in accordance with claim 1, the support device being coupled to a machine frame.

15. An apparatus for at least one of winding a material web onto and unwinding a material web off of a winding roll comprising:

a winding roll;

a support device, adapted to be positioned against a circumferential portion of the winding roll, comprising:

a plurality of more than two rotational axes arranged substantially parallel to each other and substantially parallel to a winding axis of the winding roll;

a plurality of more than two rotational rollers arranged along the plurality of more than two rotational axes;

the plurality of more than two rotational rollers being swivelably coupled to one another substantially perpendicularly to the rotational axes and being formed as one of a belt and a chain; and the support device having circumferential ends and further comprising a tensioning device located on at least one of the circumferential ends that is biased in a direction against the force of gravity.

16. The apparatus in accordance with claim 15, the tensioning device having a lifting device coupled to a base in articulated fashion.

17. The apparatus in accordance with claim 15, the tensioning device being located on both circumferential ends.

18. An apparatus for at least one of winding a material web onto and unwinding a material web off of a winding roll comprising:

a winding roll;

a support device, adapted to be positioned against a circumferential portion of the winding roll, comprising:

a plurality of more than two rotational axes arranged substantially parallel to each other and substantially parallel to a winding axis of the winding roll;

a plurality of more than two rotational rollers arranged along the plurality of more than two rotational axes;

the plurality of more than two rotational rollers being swivelably coupled to one another substantially perpendicularly to the rotational axes and being formed as one of a belt and a chain; and the support device having circumferential ends and further comprising a tensioning device coupled to the circumferential ends that is biased in a horizontal direction.

19. An apparatus for at least one of winding a material web onto and unwinding a material web off of a winding roll comprising:

a winding roll;

a support device, adapted to be positioned against a circumferential portion of the winding roll, comprising:

a plurality of more than two rotational axes arranged substantially parallel to each other and substantially parallel to a winding axis of the winding roll;

a plurality of more than two rotational rollers arranged along the plurality of more than two rotational axes;

the plurality of more than two rotational rollers being swivelably coupled to one another substantially perpendicularly to the rotational axes and being formed as one of a belt and a chain;

the rollers being composed of wheels, wherein a plurality of the wheels are arranged on a common axis with an axial gap provided between adjacent wheels; and a connector that couples adjacent rotational axes, the connector being located within the axial gap.

20. An apparatus for at least one of winding a material web onto and unwinding a material web off of a winding roll comprising:

a winding roll;

a support device, adapted to be positioned against a circumferential portion of the winding roll, comprising:

a plurality of more than two rotational axes arranged substantially parallel to each other and substantially parallel to a winding axis of the winding roll;

a plurality of more than two rotational rollers arranged along the plurality of more than two rotational axes; and the plurality of more than two rotational rollers being swivelably coupled to one another substantially perpendiculary to the rotational axes and being formed as one of a belt and a chain, wherein the rollers are coupled to one another with an elastic carrier in a circumferential direction.

21. An apparatus for at least one of winding a material web onto and unwinding a material web off of a winding roll comprising:

a winding roll;

a support device, adapted to be positioned against a circumferential portion of the winding roll, comprising:

a plurality of more than two rotational axes arranged substantially parallel to each other and substantially parallel to a winding axis of the winding roll;

a plurality of more than two rotational rollers arranged along the plurality of more than two rotational axes;

the plurality of more than two rotational rollers being swivelably coupled to one another substantially perpendicularly to the rotational axes and being formed as one of a belt and a chain; and at least one of the plurality of rollers having a ventilator arrangement.

22. An apparatus for at least one of winding a material web onto and unwinding a material web off of a winding roll comprising:

a winding roll;

a support device, adapted to be positioned against a circumferential portion of the winding roll, comprising:

a plurality of more than two rotational axes arranged substantially parallel to each other and substantially parallel to a winding axis of the winding roll;

a plurality of more than two rotational rollers arranged along the plurality of more than two rotational axes;

the plurality of more than two rotational rollers being swivelably coupled to one another substantially perpendicularly to the rotational axes and being formed as one of a belt and a chain; and the support device comprising circumferential ends coupled to rocker arms, wherein the rocker arms positioned at a same axial end of the support device are coupled together by a cylinder piston device.

23. A process for winding at least one of a material web onto and a material web off of a winding roll having a stationary axis, the process comprising:

turning the winding roll;

horizontally tensioning a support device formed as one of a belt and chain;

upon attaining a predefined roll diameter, supporting a circumference of the winding roll from below with the support device; and vertically moving ends of the support device at a rate of speed less than approximately a rate of change of diameter of the winding roll.

24. The process in accordance with claim 23, wherein the ends of the support device are held in a vertical position below the predefined roll diameter of the winding roll.

25. The process in accordance with claim 24, wherein the predefined roll diameter of the winding roll is less than approximately 800 mm.

26. The process in accordance with claim 24, wherein the ends of the support device are held stationary at a level that is a distance of approximately 45% of the predefined roll diameter below the winding roll axis.

27. The process in accordance with claim 23, further comprising:

deforming a peripheral surface of a plurality of support elements of the support device as the diameter of the winding roll increases.

28. The process in accordance with claim 27, further comprising:

automatically cooling the deformed support elements of the support device, wherein at least one of the support elements includes a ventilation device.

29. An support device for supporting a winding roll in one of a winding-on and a winding-off of the winding roll comprising:

a winding roll having a winding axis;

a plurality of more than two rotational rollers being arranged parallelly to each other and to the winding axis of the winding roll; and the plurality of more than two rotational rollers being swivelably coupled to one another in a circumferential direction and being formed as one of a belt and a chain.

30. The support device in accordance with claim 29, the plurality of rotatable rollers comprising a plurality of coaxially arranged wheels having axial gaps provided between adjacent coaxial wheels.

31. A support device for supporting a winding roll in one of a winding-on and a winding-off of the winding roll comprising:

a winding roll having a winding axis;

a plurality of more than two rotational rollers being arranged parallelly to each other and to the winding axis of the winding roll;

plurality of more than two rotational rollers being swivelably coupled to one another in a circumferential direction and being formed as one of a belt and a chain;

a first and second circumferential end; and a tensioning device coupled to each of the first and second end, the tensioning device being adapted to bias the circumferential ends in at least one of a horizontal direction away from each other and a vertical upward direction.

32. A support device for supporting a winding roll in one of a winding-on and a winding-off of the winding roll comprising:

a winding roll having a winding axis;

a plurality of more than two rotational rollers being arranged parallelly to each other and to the winding axis of the winding roll;

the plurality of more than two rotational rollers being swivelably coupled to one another in a circumferential direction and being formed as one of a belt and a chain; and the plurality of rotatable rollers comprising a plurality of coaxially arranged wheels having axial gaps provided between adjacent coaxial wheels, wherein the plurality of rotatable rollers are arranged such that at least a portion of a circumferentially adjacent wheel extends into the axial gap between adjacent coaxial wheels.

* * * * *